US010479632B1

(12) United States Patent
Yu Chen

(10) Patent No.: US 10,479,632 B1
(45) Date of Patent: Nov. 19, 2019

(54) STRETCH FILM DISPENSER WITH LIFTING DEVICE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 0 days.

(21) Appl. No.: 16/112,764

(22) Filed: Aug. 26, 2018

(51) Int. Cl.
*B65H 16/06* (2006.01)
*B65H 16/10* (2006.01)
*B65H 16/00* (2006.01)

(52) U.S. Cl.
CPC ..... *B65H 16/06* (2013.01); *B65H 16/005* (2013.01); *B65H 16/106* (2013.01); *B65H 2402/412* (2013.01)

(58) Field of Classification Search
CPC .... B65H 16/06; B65H 16/106; B65H 16/005; B65H 2402/412
See application file for complete search history.

(56) References Cited

U.S. PATENT DOCUMENTS 4,102,513 A * 7/1978 Guard ..... B65B 67/085 156/577
4,166,589 A * 9/1979 Hoover ..... B65B 67/085 156/577
4,535,951 A * 8/1985 Riemenschneider, III ..... B65B 67/085 242/423.2
4,714,211 A * 12/1987 Hwang ..... B65B 67/085 242/423.1
5,779,179 A * 7/1998 Zentmyer ..... B65B 67/085 242/423.2
6,883,298 B2 * 4/2005 Gooding ..... B65B 67/085 156/574
6,920,742 B1 * 7/2005 Yu Chen ..... B65B 67/085 156/574
7,228,677 B2 * 6/2007 Yu Chen ..... B65B 67/085 242/570
7,357,349 B1 * 4/2008 Huang ..... B65B 67/085 242/405.3
8,317,124 B2 * 11/2012 Yu Chen ..... B65B 67/085 242/588.6
10,059,548 B2 * 8/2018 Chen ..... B65H 23/14
10,167,101 B2 * 1/2019 Yu Chen ..... B65B 67/08
2002/0038838 A1 * 4/2002 Marois ..... B65H 16/06 242/596.6
2003/0208994 A1 * 11/2003 Gooding ..... B65B 67/085 53/557

(Continued)

*Primary Examiner* — William A. Rivera
(74) *Attorney, Agent, or Firm* — Bruce Stone LLP; Joseph Bruce

(57) ABSTRACT

A stretch film dispenser with a lifting device is disclosed. The lifting device includes a first operating unit. The first operating unit has a first through hole. The first through hole is provided with a first fixing member. The first operating unit further has a first opening. The first opening is provided with a first control member. The first operating unit is connected with an accommodating unit. The accommodating unit includes a telescopic rod therein. An outer peripheral wall of the telescopic rod is formed with a plurality of spaced first positioning holes corresponding to the first fixing member. The first fixing member is engaged in one of the plurality of first positioning holes for positioning the telescopic rod. Thereby, the telescopic adjustment of the telescopic rod is controlled by the first operating unit for articles of different heights, and the packing process is more smooth and convenient.

8 Claims, 11 Drawing Sheets

(56) References Cited

U.S. PATENT DOCUMENTS

| | | | | |
|---|---|---|---|---|
| 2011/0233321 | A1* | 9/2011 | Yu Chen | B65B 67/085<br>242/588.2 |
| 2015/0353215 | A1* | 12/2015 | Yu Chen | B65H 16/005<br>53/203 |
| 2016/0340070 | A1* | 11/2016 | Yu Chen | B65B 67/08 |
| 2016/0355373 | A1* | 12/2016 | Yu Chen | B65H 23/14 |
| 2017/0305583 | A1* | 10/2017 | Nelson | B65H 16/005 |
| 2018/0065827 | A1* | 3/2018 | Nelson | B65H 16/005 |

* cited by examiner

STRETCH FILM DISPENSER WITH LIFTING DEVICE

FIELD OF THE INVENTION

The present invention relates to a stretch film dispenser, and more particularly to a stretch film dispenser with a lifting device.

BACKGROUND OF THE INVENTION

In order to prevent damages to articles caused by shaking or falling during storage or transport, a stretch film dispenser is used for packing the articles. A conventional stretch film dispenser comprises a rod. One end of the rod is provided with a film mounting unit. The film mounting unit is provided with a film roll. When the user wants to pack an article, the film of the film roll is first pulled out, and then one end of the film is attached to the surface of the article. The user holds the rod to pull the stretch film dispenser for performing the packing operation. However, although the stretch film dispenser is convenient for the user to pack the article, the length of the rod cannot be adjusted. For the article that is located at a higher or lower position, it is inconvenient for the user to apply a force to pack the article, and the tension of the film is reduced.

In view of the disadvantages of the above stretch film dispenser, a stretch film dispenser having a long handle is developed accordingly. One end of the long handle is provided with a film mounting unit for mounting a film roll. Thereby, when the user packs a large article, the long handle of the stretch film dispenser can be raised or lowered to facilitate the packing operation. However, when the user packs an article that is located at the normal height, the long handle may affect the user's operation to bring inconvenience. When the user packs the article in the reverse direction from a high position to a low position, it is necessary to change the direction of the film. As a result, the continuity of the film is destroyed, and the tension is lowered. Accordingly, the inventor of the present invention has devoted himself based on his many years of practical experiences to solve these problems.

SUMMARY OF THE INVENTION

The primary object of the present invention is to provide a stretch film dispenser with a lifting device, which is convenient for the user to hold the stretch film dispenser to pack articles in different heights. The continuity of the film can be extended to increase the tension of the film.

Another object of the present invention is to provide a stretch film dispenser with a lifting device, which provides a telescopic rod that can be bi-directionally extended and adjusted for the user to apply a force at different heights.

In order to achieve the aforesaid object, a stretch film dispenser with a lifting device is provided. The stretch film dispenser comprises a first seat and a second seat. The lifting device is disposed between the first seat and the second seat. A first operating unit is connected to the first seat. The first operating unit has a first through hole. The first through hole is provided with a first fixing member. The first operating unit further has a first opening. The first opening is in communication with the first through hole. The first opening of the first operating unit is provided with a first control member. The first control member has a first perforation. The first control member has a first limiting hole corresponding in position to the first fixing member. An accommodating unit has a first end connected to the first operating unit and a second end connected to the second seat. The accommodating unit has a receiving hole therein for accommodating a telescopic rod. An outer peripheral wall of the telescopic rod is formed with a plurality of spaced first positioning holes corresponding to the first fixing member. The first fixing member passes through the first limiting hole and is engaged in one of the plurality of first positioning holes for positioning the telescopic rod.

In order to achieve another object, the stretch film dispenser further comprises a second operating unit connected to the second seat. The second operating unit has a second through hole. The second through hole is provided with a second elastic member. The second operating unit further has a second opening. The second opening is in communication with the second through hole. The second opening of the second operating unit is provided with a second control member. The second control member has a second perforation. The second control member has a second limiting hole corresponding in position to the second fixing member.

The lifting device of the stretch film dispenser provided by the present invention controls the telescopic rod to extend up and down through the first operating unit and the second operating unit, so that the stretch film dispenser is suitable for articles of different heights. The telescopic rod has the function of bidirectional telescopic adjustment. The user can hold and pull the telescopic rod for performing the packing operation, so that the packing operation is smoother and more convenient, and the continuity of the film can be extended to increase the tension of the film.

DETAILED DESCRIPTION OF THE PREFERRED EMBODIMENTS

Embodiments of the present invention will now be described, by way of example only, with reference to the accompanying drawings.

Figure 1:
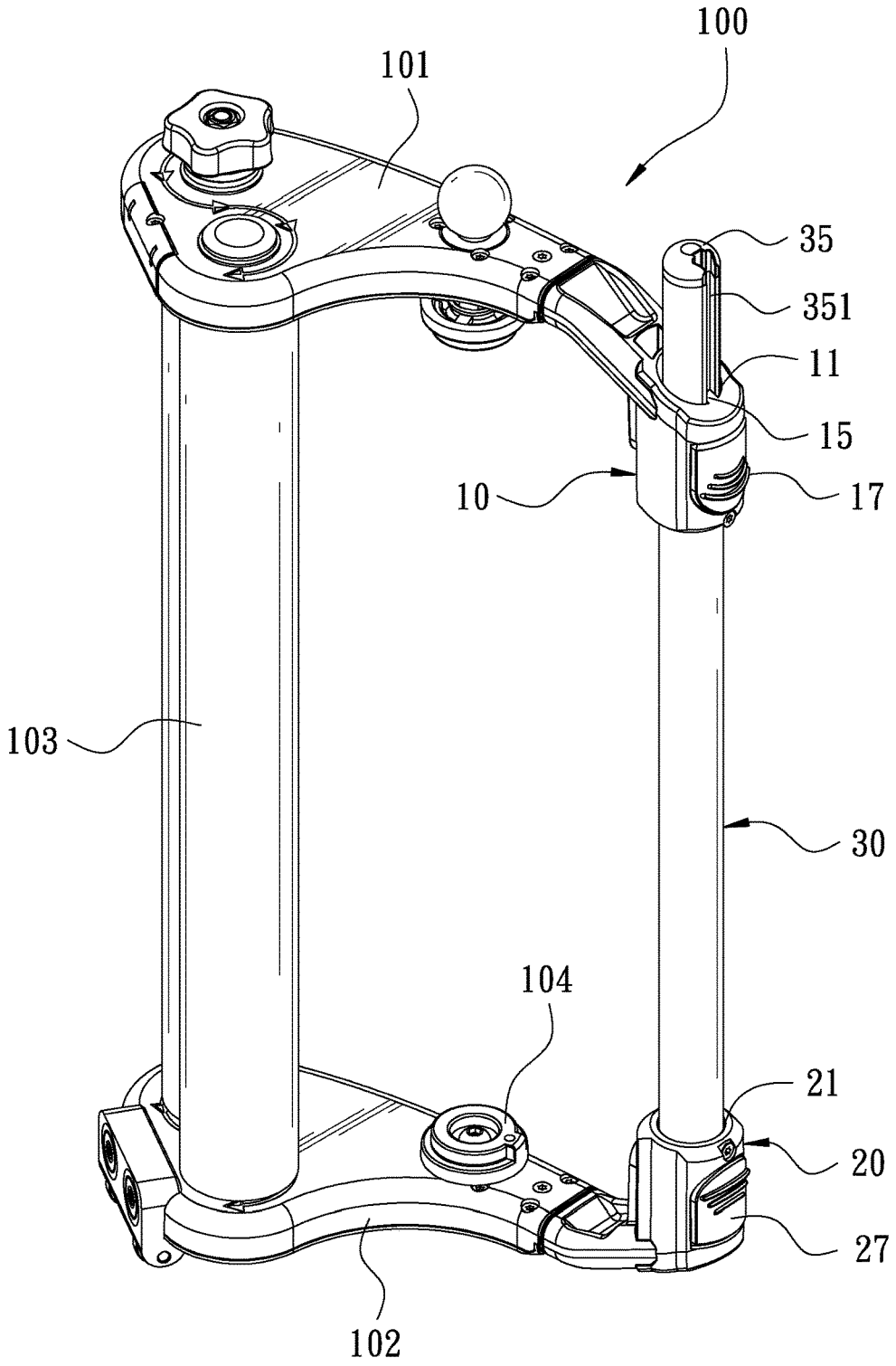
FIG. 1 is a perspective view in accordance with a preferred embodiment of the present invention.

FIG. 1 is a perspective view in accordance with a preferred embodiment of the present invention. The present invention discloses a stretch film dispenser with a lifting device. The lifting device is mounted to a stretch film dispenser 100. The stretch film dispenser 100 comprises a first seat 101 and a second seat 102. The lifting device is disposed between the first seat 101 and the second seat 102. The stretch film dispenser 100 further comprises a roller assembly 103 and a film mounting unit 104.

Figure 2:
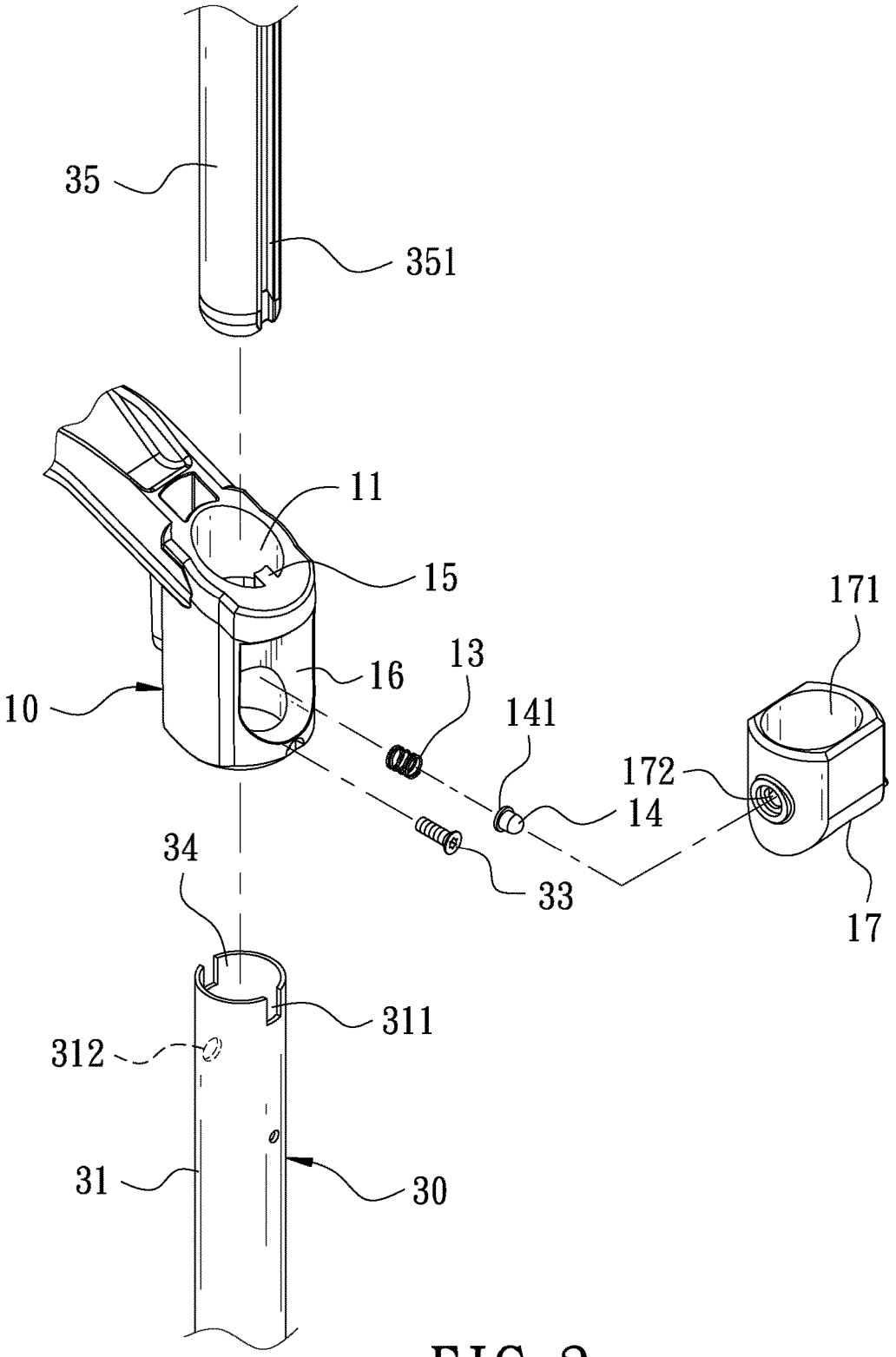
FIG. 2 is an exploded view of the first operating unit in accordance with the preferred embodiment of the present invention.
Figure 3:
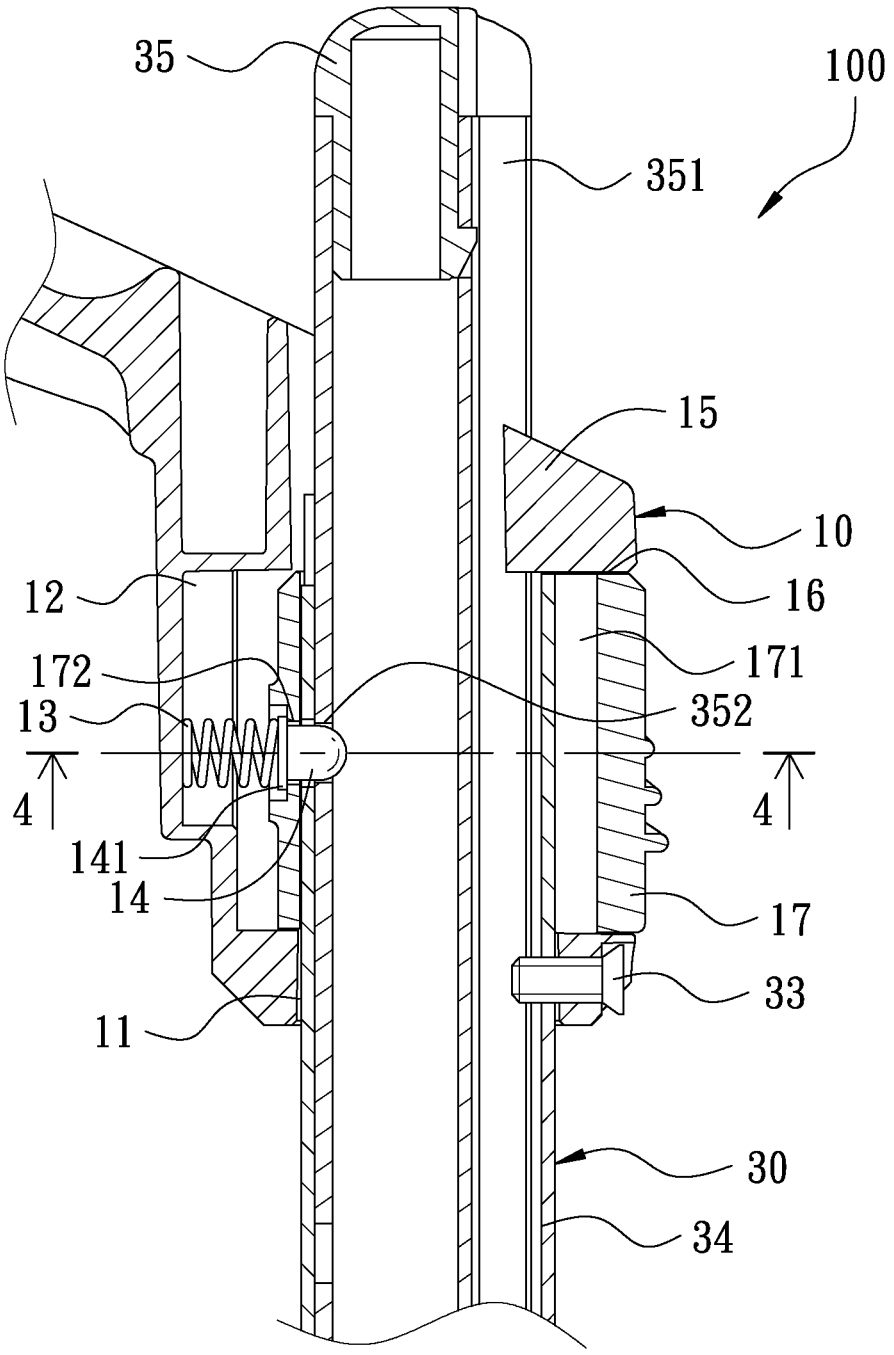
FIG. 3 is a sectional view of the first operating unit in accordance with the preferred embodiment of the present invention.
Figure 4:
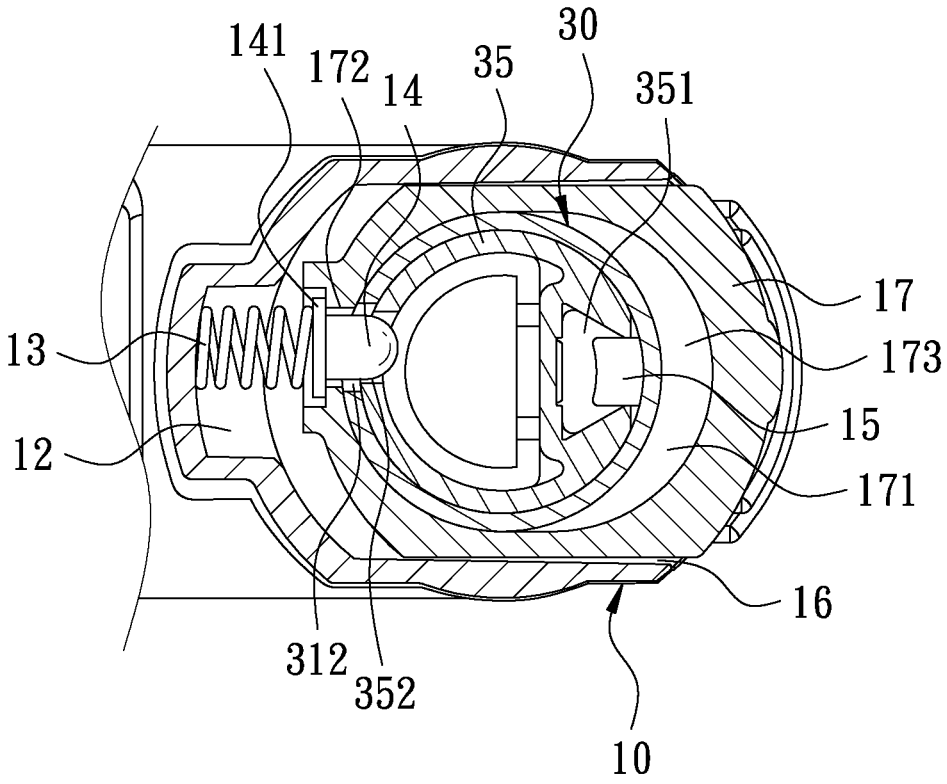
FIG. 4 is a sectional view taken along line 4-4 of FIG. 3.

Referring to FIG. 2 and FIG. 3, a first operating unit 10 is connected to one end of the first seat 101. The first operating unit 10 is provided with a first through hole 11. A peripheral wall of the first through hole 11 is formed with a first accommodating recess 12. The first accommodating recess 12 is provided with a first elastic member 13. An elastic end of the first elastic member 13 leans against a first fixing member 14. An immovable end of the first fixing member 14 is formed with an annular first flange 141. The first flange 141 is biased by the first elastic member 13. A first positioning block 15 protrudes from the peripheral wall of the first through hole 11. An outer peripheral wall of the first operating unit 10 is formed with a first opening 16 corresponding in position to the first accommodating recess 12. The first opening 16 is in communication with the first through hole 11. The first opening 16 of the first operating unit 10 is provided with a first control member 17. The first control member 17 has an elliptical first perforation 171. The central axis of the first perforation 171 is parallel to the central axis of the first through hole 11. As shown in FIG. 4, the first control member 17 has a first limiting hole 172 corresponding to the first fixing member 14. The first flange 141 of the first fixing member 14 is blocked by the first limiting hole 172 of the first control member 17. A free end of the first fixing member 14 is inserted into the first perforation 171 of the first control member 17.

Figure 5:
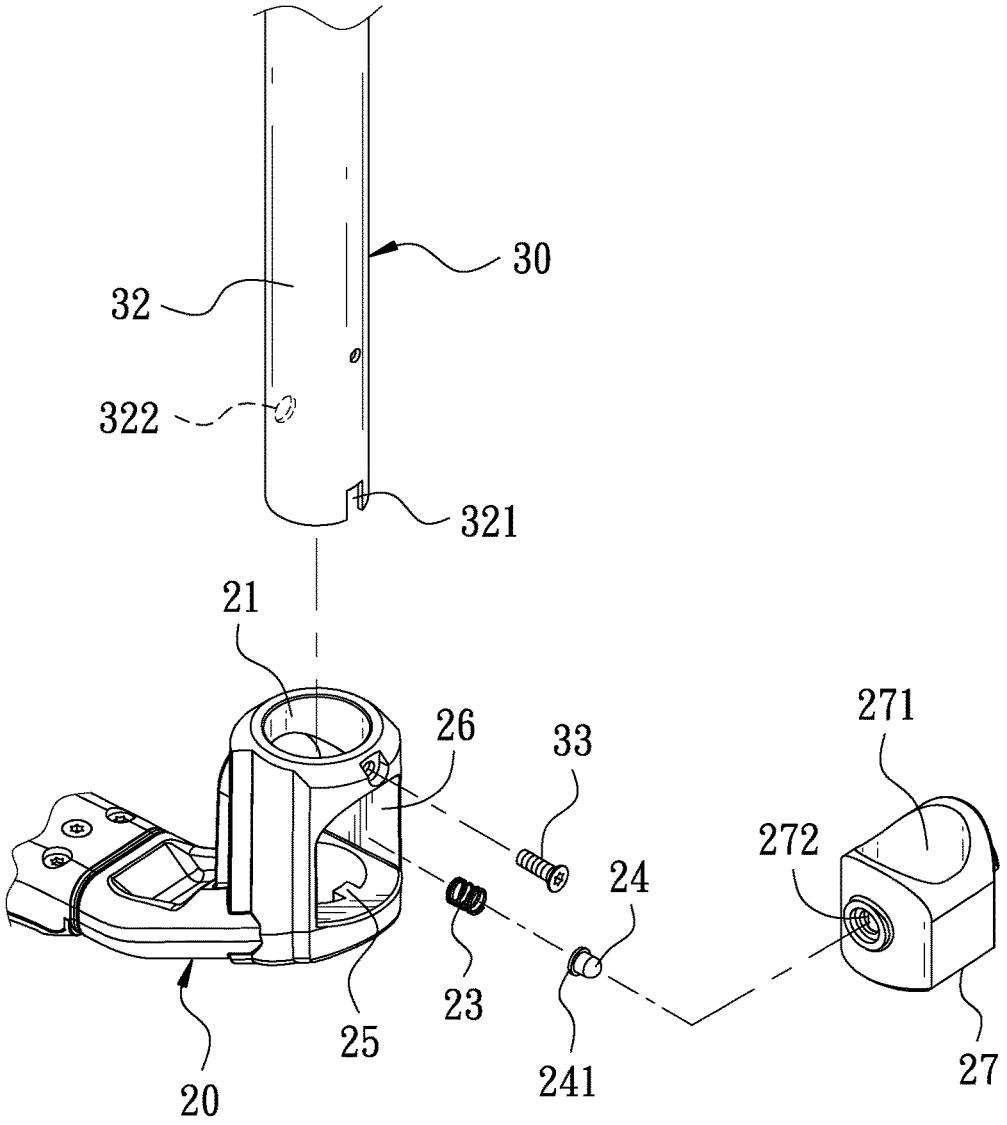
FIG. 5 is an exploded view of the second operating unit in accordance with the preferred embodiment of the present invention.
Figure 6:
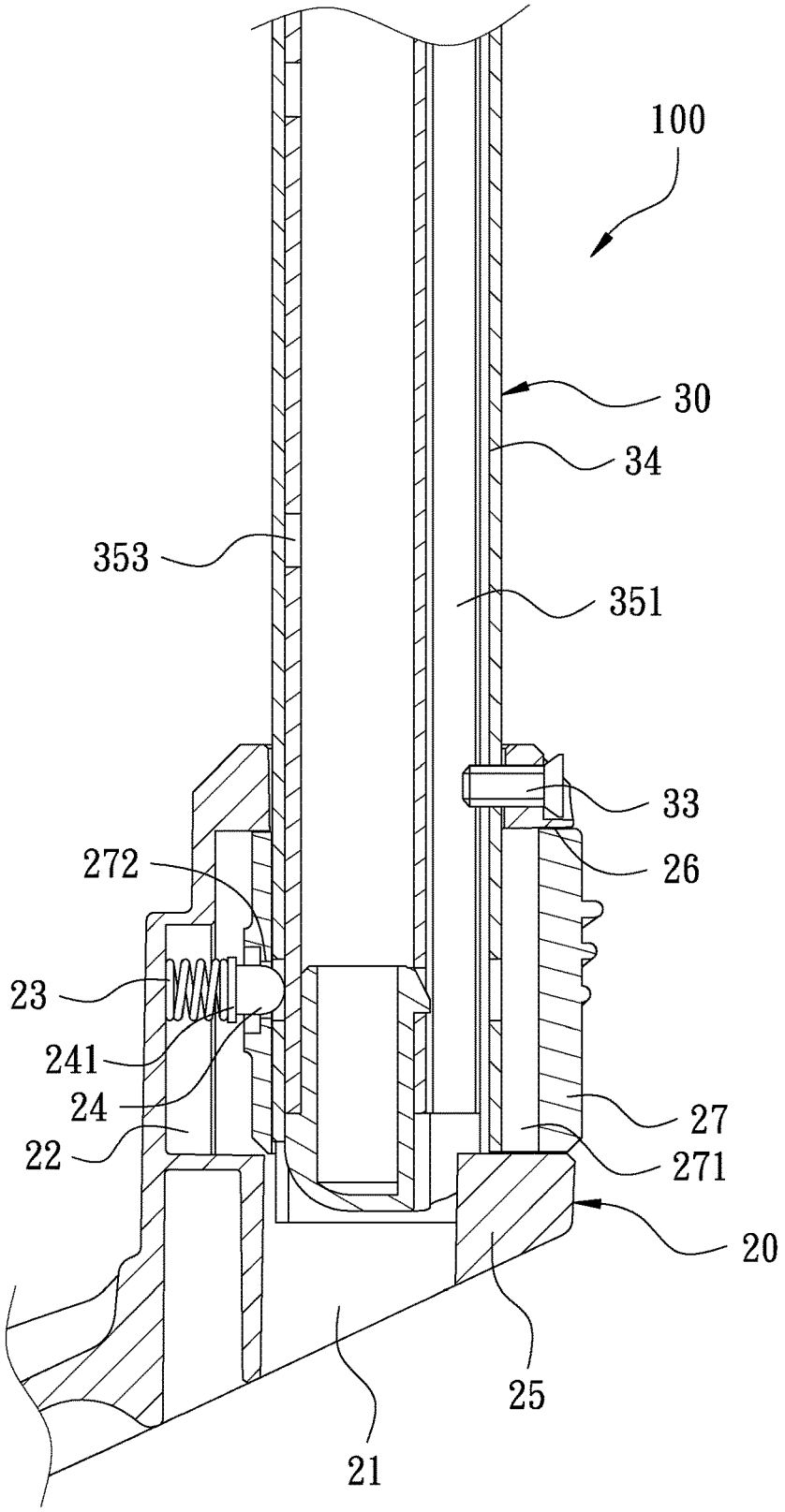
FIG. 6 is a sectional view of the second operating unit in accordance with the preferred embodiment of the present invention.
Figure 11:
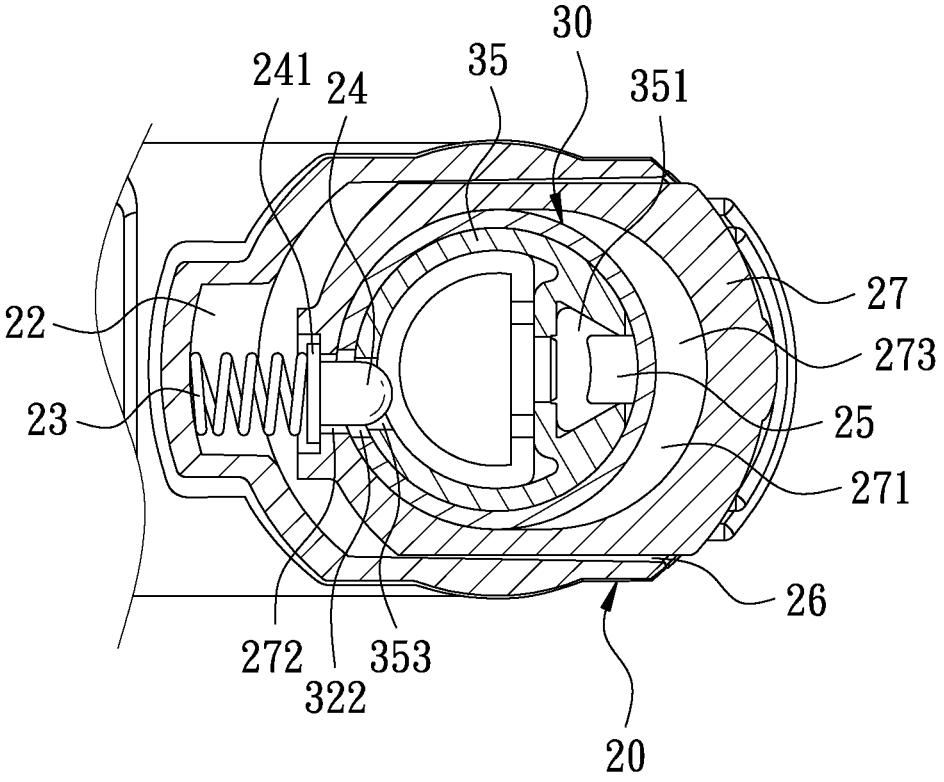
FIG. 11 is a sectional view taken along line 11-11 of FIG. 10.

Referring to FIG. 5 and FIG. 6, a second operating unit 20 is connected to one end of the second seat 102. The second operating unit 20 is provided with a second through hole 21. A peripheral wall of the second through hole 21 is formed with a second accommodating recess 22. The second accommodating recess 22 is provided with a second elastic member 23. An elastic end of the second elastic member 23 leans against a second fixing member 24. An immovable end of the second fixing member 24 is formed with an annular second flange 241. The second flange 241 is biased by the second elastic member 23. A second positioning block 25 protrudes from the peripheral wall of the second through hole 21. The first positioning block 15 is parallel to the second positioning block 25. An outer peripheral wall of the second operating unit 20 is formed with a second opening 26 corresponding in position to the second accommodating recess 22. The second opening 26 is in communication with the second through hole 21. The second opening 26 of the second operating unit 20 is provided with a second control member 27. The second control member 27 has an elliptical second perforation 271. The central axis of the second perforation 271 is parallel to the central axis of the second through hole 21. As shown in FIG. 11, the second control member 27 has a second limiting hole 272 corresponding to the second fixing member 24. The second flange 241 of the second fixing member 24 is blocked by the second limiting hole 272 of the second control member 27. A free end of the second fixing member 24 is inserted into the second perforation 271 of the second control member 27.

An accommodating unit 30 has a first end 31 disposed in the first through hole 11 of the first operating unit 10 and a second end 32 disposed in the second through hole 21 of the second operating unit 20. Referring to FIG. 2, FIG. 3 and FIG. 4, the first end 31 of the accommodating unit 30 is formed with a first engaging notch 311 corresponding to the first positioning block 15 of the first through hole 11. The first engaging notch 311 is engaged with the first positioning block 15. The accommodating unit 30 is locked by a screw 33. The first end 31 has a first aperture 312 corresponding to the first limiting hole 172 of the first control member 17. The free end of the first fixing member 14 passes through the first aperture 312. Please refer to FIG. 5, FIG. 6, FIG. 10 and FIG. 11, the second end 32 of the accommodating unit 30 is formed with a second engaging notch 321 corresponding to the second positioning block 25 of the second through hole 21. The second engaging notch 321 is engaged with the second positioning block 25. The accommodating unit 30 is locked by a screw 33. In the embodiment, the accommodating unit 30 is a hollow tube. The accommodating unit 30 has a receiving hole 34 therein. The receiving hole 34 is provided with a telescopic rod 35. The length of the telescopic rod 35 is greater than the length of the accommodating unit 30. An outer peripheral wall of the telescopic rod 35 is formed with a groove 351 corresponding to the first positioning block 15 and the second positioning block 25 for limiting the telescopic rod 35. Please refer to FIG. 7. The telescopic rod 35 defines a first axis a and a second axis b. The first axis a and the second axis b are spaced apart from each other. The telescopic rod 35 is formed with a plurality of first positioning holes 352 that are arranged along the first axis a and equally spaced apart from each other, so that the first fixing member 14 passes through the first limiting hole 172 and is engaged in one of the plurality of first positioning holes 352 for positioning the telescopic rod 35. The telescopic rod 35 is formed with a plurality of second positioning holes 353 that are arranged along the second axis b and equally spaced apart from each other, so that the second fixing member 24 passes through the second limiting hole 272 and is engaged in one of the plurality of second positioning holes 353 for positioning the telescopic rod 35. Thereby, the telescopic rod 35 can be independently operated to extend upward or retract downwardly, which is a preferred embodiment of the present invention, but not limited thereto. The first positioning holes 352 and the second positioning holes 353 may be in different shapes to achieve the effect of not interfering with each other and independently controlling up and down movement.

Figure 8:
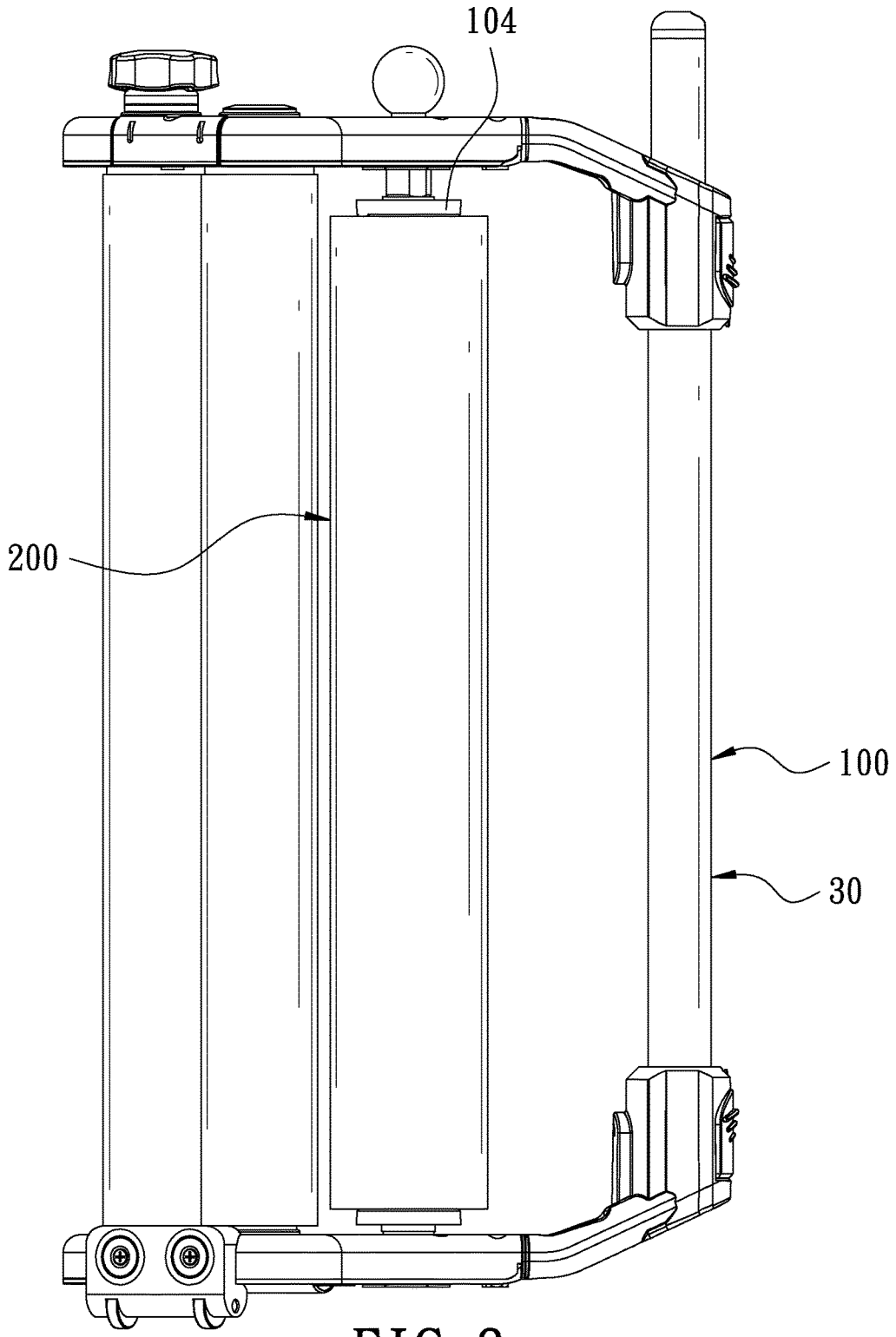
FIG. 8 is a schematic view in accordance with the preferred embodiment of the present invention when in use, showing that the film roll is mounted.

Please refer to FIG. 8. When in use, a film roll 200 is first mounted to the film mounting unit 104 of the stretch film dispenser 100, and then the film of the film roll 200 is wound around the roller assembly 103, so that the stretch film dispenser 100 can be used for packing articles. When the user is in the normal position, one end of the film roll 200 is attached to an article, and then the user holds and pulls the accommodating unit 30 for performing the packing operation.

Figure 9:
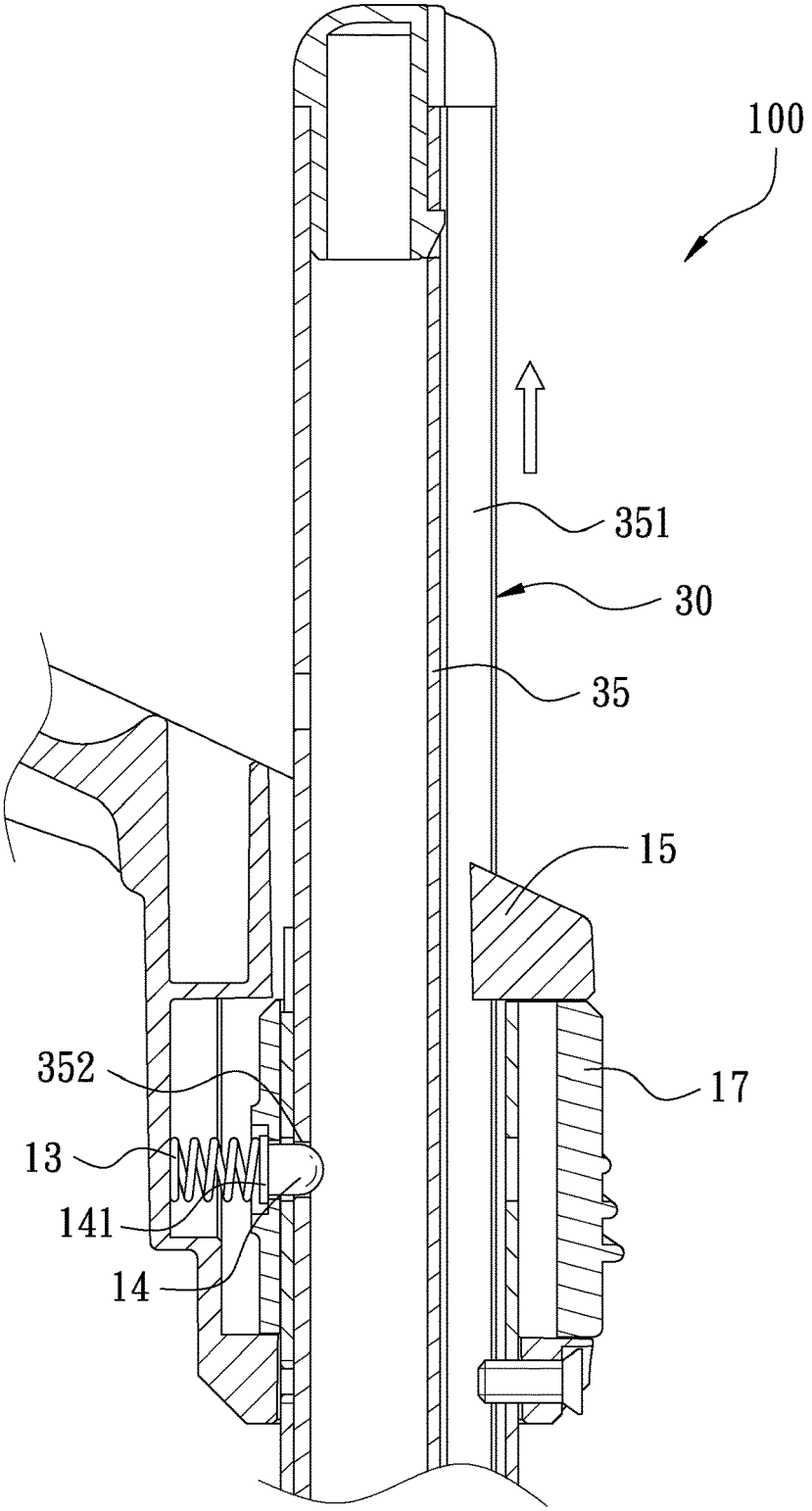
FIG. 9 is a schematic view in accordance with the preferred embodiment of the present invention when in use, showing that the telescopic rod is pulled upward.

Referring to FIG. 9, when the user wants to adjust the telescopic rod 35 to extend upwardly, the first control member 17 is first pressed to push the first flange 141 of the first fixing member 14, so that the first fixing member 14 is disengaged from the first positioning hole 352 of the telescopic rod 35 to adjust the length of the telescopic rod 35. After the telescopic rod 35 is pulled upward for a predetermined length, the first control member 17 is released, and the first fixing member 14 is pushed by the elastic force of the first elastic member 13, and the free end of the first fixing member 14 is engaged in one of the plurality of first positioning holes 352 to position the telescopic rod 35. Thereby, the stretch film dispenser 100 can be lifted to be suitable for articles of different heights, and the user can hold the telescopic rod 35 for performing the packing operation, so that the packing operation is more smooth and convenient.

It should be noted that when the telescopic rod 35 is pulled upward, the groove 351 of the telescopic rod 35 is subjected to the first positioning block 15 so that the telescopic rod 35 does not rotate when being pulled. After the telescopic rod 35 is pulled upward for a predetermined length, the first control member 17 is released, and the first fixing member 14 is biased by the first elastic member 13, so that the first fixing member 14 is accurately engaged with one of the first positioning holes 352 for positioning the telescopic rod 35.

Figure 10:
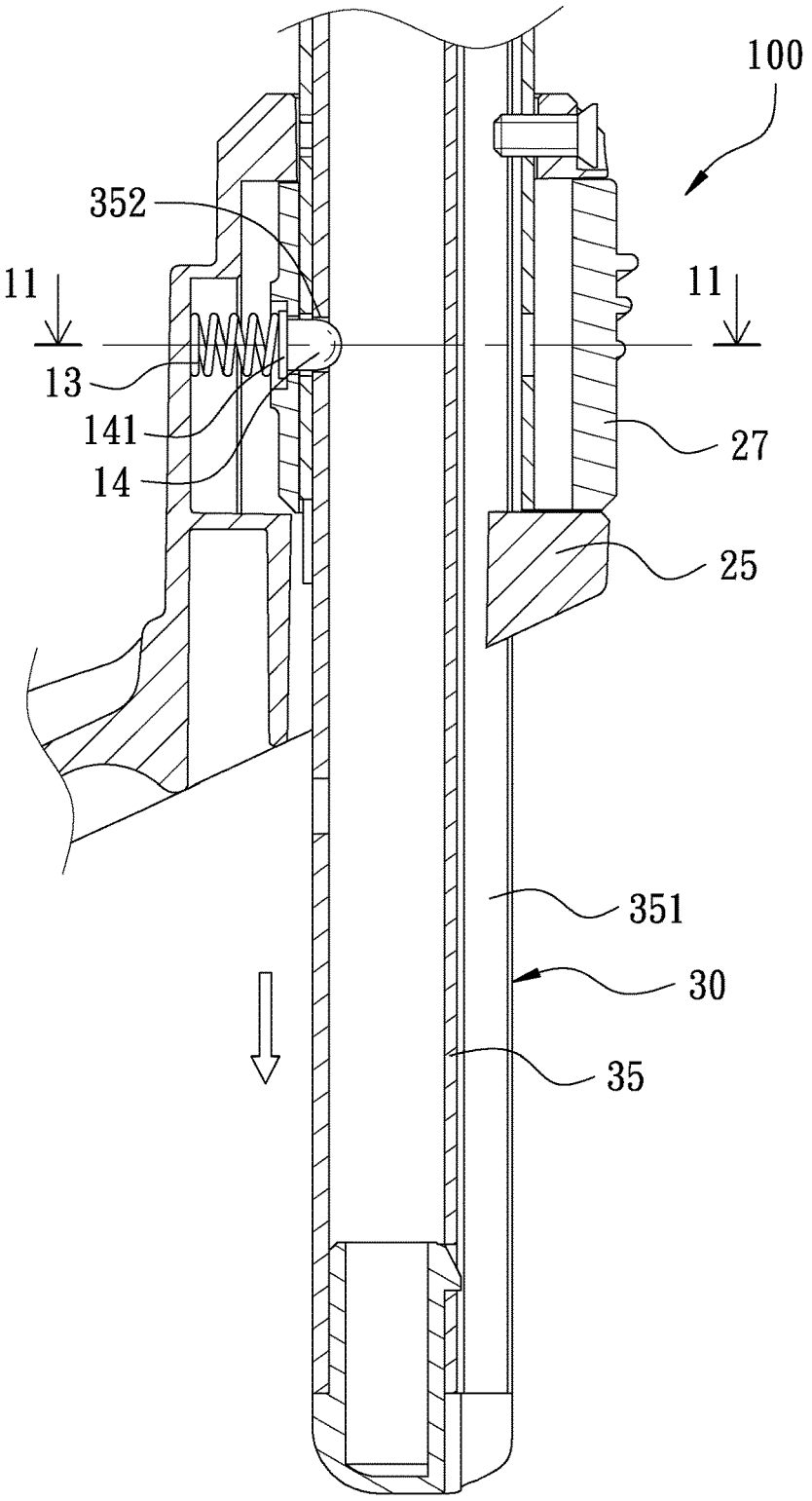
FIG. 10 is a schematic view in accordance with the preferred embodiment of the present invention when in use, showing that the telescopic rod is pulled downward.

Referring to FIG. 10 and FIG. 11 in cooperation with FIG. 9, when the user wants to adjust the telescopic rod 35 to extend downwardly, the first control member 17 is first pressed to push the first fixing member 14, so that the first fixing member 14 is disengaged from the first positioning hole 352 of the telescopic rod 35, and then the telescopic rod 35 can be pulled downwardly. After that, the second control member 27 is pressed to push the second flange 241 of the second fixing member 24, so that the second fixing member 24 is disengaged from the second positioning hole 353 of the telescopic rod 35 to adjust the length of the telescopic rod 35. After the telescopic rod 35 is pulled downward for a predetermined length, the second control member 27 is released, and the second fixing member 24 is pushed by the second elastic member 23, and the free end of the second fixing member 24 is engaged in one of the plurality of second positioning holes 353 to position the telescopic rod 35. Thereby, the stretch film dispenser 100 can be lowered to be suitable for articles of different heights. The telescopic rod 35 has the effect of bidirectional telescopic adjustment.

It should be noted that when the telescopic rod 35 is pulled downward, the groove 351 of the telescopic rod 35 is subjected to the second positioning block 25 so that the telescopic rod 35 does not rotate when being pulled. After the telescopic rod 35 is pulled downward for a predetermined length, the second control member 27 is released, and the second fixing member 24 is biased by the second elastic member 23, so that the second fixing member 24 is accurately engaged with one of the second positioning holes 353 for positioning the telescopic rod 35.

Figure 7:
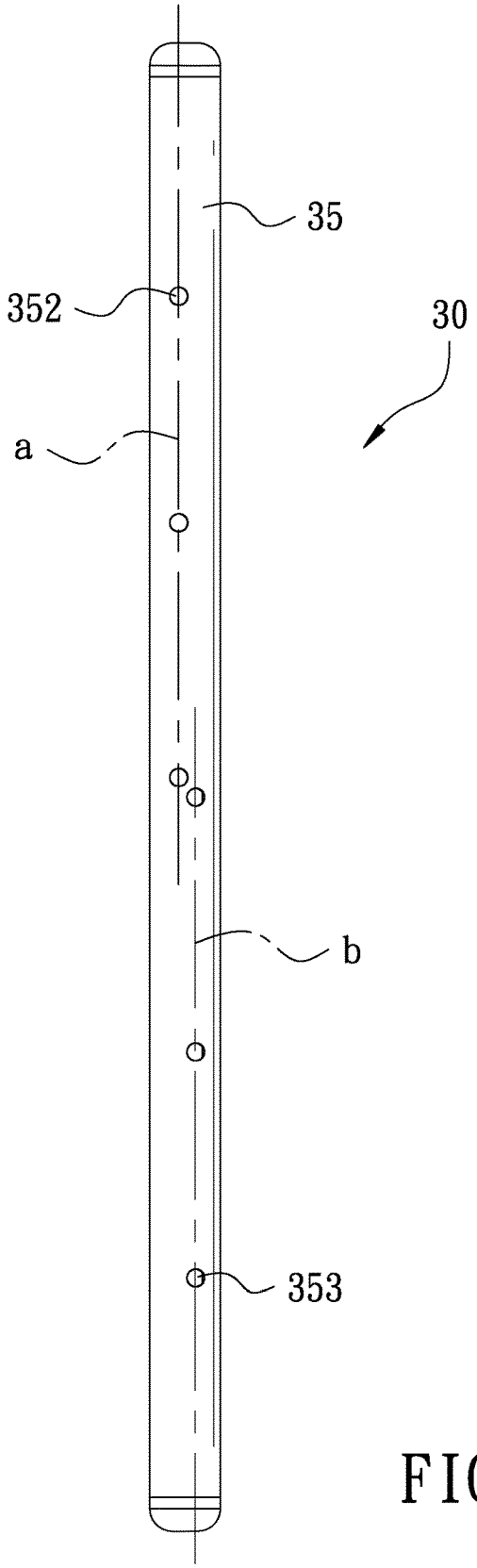
FIG. 7 is a side view of the telescopic rod in accordance with the preferred embodiment of the present invention.

It is worth mentioning that, referring to FIG. 4, the first perforation 171 of the first operating unit 10 is elliptical. When the accommodating unit 30 is inserted through the first perforation 171, there is a gap 173 to provide an operation space between the first control member 17 and the accommodating unit 30. When the first control member 17 is pressed, the first control member 17 pushes the first fixing member 14 and the first elastic member 13 to disengage the first fixing member 14 from the first positioning hole 352 of the telescopic rod 35, so that the telescopic rod 35 can be pulled upward. Referring to FIG. 7, the second perforation 271 of the second operating unit 20 is elliptical. When the accommodating unit 30 is inserted through the second perforation 271, there is a gap 273 to provide an operation space between the second control member 27 and the accommodating unit 30. When the second control member 27 is pressed, the second control member 27 pushes the second fixing member 24 and the second elastic member 23 to disengage the second fixing member 24 from the second positioning hole 353 of the telescopic rod 35, so that the telescopic rod 35 can be pulled downward.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A stretch film dispenser with a lifting device, the stretch film dispenser comprising a first seat and a second seat, the lifting device being disposed between the first seat and the second seat, characterized by:

a first operating unit, connected to the first seat, the first operating unit having a first through hole, the first through hole being provided with a first fixing member, the first operating unit further having a first opening, the first opening being in communication with the first through hole, the first opening of the first operating unit being provided with a first control member, the first control member having a first perforation, the first control member having a first limiting hole corresponding in position to the first fixing member;

an accommodating unit, having a first end connected to the first operating unit and a second end connected to the second seat, the accommodating unit having a receiving hole therein for accommodating a telescopic rod, an outer peripheral wall of the telescopic rod being formed with a plurality of spaced first positioning holes corresponding to the first fixing member, the first fixing member passing through the first limiting hole and being engaged in one of the plurality of first positioning holes for positioning the telescopic rod.

2. The stretch film dispenser with the lifting device as claimed in claim 1, wherein a peripheral wall of the first through hole is formed with a first accommodating recess, the first accommodating recess is provided with a first elastic member, an elastic end of the first elastic member leans against the first fixing member, an immovable end of the first fixing member is formed with an annular first flange, the first flange is biased by the first elastic member, the first flange of the first fixing member is blocked by the first limiting hole of the first control member, a free end of the first fixing member passes through the first perforation of the first control member and is inserted in one of the plurality of first positioning holes of the telescopic rod, when the first control member is pressed, the first control member pushes the first fixing member to disengage from the first positioning hole.

3. The stretch film dispenser with the lifting device as claimed in claim 1, further comprising a second operating unit connected to the second seat, the second end of the accommodating unit being provided with the second operating unit, the second operating unit having a second through hole, the second through hole being provided with a second elastic member, the second operating unit further having a second opening, the second opening being in communication with the second through hole, the second opening of the second operating unit being provided with a second control member, the second control member having a second perforation, the second control member having a second limiting hole corresponding in position to the second fixing member, the outer peripheral wall of the telescopic rod being formed with a plurality of spaced second positioning holes corresponding to the second fixing member.

4. The stretch film dispenser with the lifting device as claimed in claim 3, wherein a peripheral wall of the second through hole is formed with a second accommodating recess, the second accommodating recess is provided with a second elastic member, an elastic end of the second elastic member leans against the second fixing member, an immovable end of the second fixing member is formed with an annular second flange, the second flange is biased by the second elastic member, the second flange of the second fixing member is blocked by the second limiting hole of the second control member, a free end of the second fixing member passes through the second perforation of the second control member and is inserted in one of the plurality of second positioning holes of the telescopic rod, when the second control member is pressed, the second control member pushes the second fixing member to disengage from the second positioning hole.

5. The stretch film dispenser with the lifting device as claimed in claim 3, wherein a first positioning block protrudes from a peripheral wall of the first through hole of the first operating unit, a second positioning block protrudes from a peripheral wall of the second through hole of the second operating unit, and the telescopic rod is formed with a groove corresponding to the first positioning block and the second positioning block.

6. The stretch film dispenser with the lifting device as claimed in claim 5, wherein the telescopic rod defines a first axis and a second axis, the first axis and the second axis are spaced apart from each other, the telescopic rod is formed with the plurality of first positioning holes that are arranged along the first axis and equally spaced apart from each other, and the telescopic rod is formed with the plurality of second positioning holes that are arranged along the second axis and equally spaced apart from each other.

7. The stretch film dispenser with the lifting device as claimed in claim 3, wherein the first perforation of the first control member is elliptical, and the second perforation of the second control member is elliptical.

8. The stretch film dispenser with the lifting device as claimed in claim 1, wherein the telescopic rod has a length greater than that of the accommodating unit.

* * * * *